US010042283B2

(12) United States Patent
Kamiyama

(10) Patent No.: US 10,042,283 B2
(45) Date of Patent: Aug. 7, 2018

(54) DEVELOPING DEVICE THAT REMOVES TONER ACCUMULATED ON TOP SURFACE OF REGULATING BLADE WITH SIMPLE CONFIGURATION, AND IMAGE FORMING APPARATUS INCLUDING THE SAME

(71) Applicant: Kyocera Document Solutions Inc., Osaka (JP)

(72) Inventor: Yuji Kamiyama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/641,347

(22) Filed: Jul. 5, 2017

(65) Prior Publication Data

US 2018/0011419 A1 Jan. 11, 2018

(30) Foreign Application Priority Data

Jul. 5, 2016 (JP) ..... 2016-133226

(51) Int. Cl.
*G03G 15/08* (2006.01)

(52) U.S. Cl.
CPC ..... *G03G 15/0812* (2013.01)

(58) Field of Classification Search
CPC ..... G03G 15/0812
See application file for complete search history.

(56) References Cited

U.S. PATENT DOCUMENTS 4,373,798 A * 2/1983 Tsukada ..... G03G 15/09 399/267
4,624,545 A * 11/1986 Yasuda ..... G03G 15/0914 399/274
4,930,438 A * 6/1990 Demizu ..... G03G 15/0808 399/281
5,172,170 A * 12/1992 Hays ..... G03G 15/0803 29/895
5,623,717 A * 4/1997 Takenaka ..... G03G 15/0808 399/281
5,890,042 A * 3/1999 Wong ..... G03G 15/0803 399/285

(Continued)

FOREIGN PATENT DOCUMENTS

JP 2012-208469 A 10/2012
JP 2014-006411 A 1/2014

*Primary Examiner* — G. M. Hyder
(74) *Attorney, Agent, or Firm* — James Judge

(57) ABSTRACT

A developing device includes a developing roller, a toner supply roller, a regulating blade, a casing, and a cleaning member. The developing roller supplies a toner to the image carrier in a region opposed to an image carrier. The toner supply roller is located opposed to the developing roller. The toner supply roller forms a magnetic brush made of a two-component developer including a magnetic carrier and a toner on an outer peripheral surface to supply a toner to the developing roller in a region opposed to the developing roller. The regulating blade is located opposed to the toner supply roller at a predetermined interval. The casing houses the developing roller, the toner supply roller, and the regulating blade. The cleaning member reciprocates along a longitudinal direction of the regulating blade so as to remove a toner accumulated on a top surface of the regulating blade.

11 Claims, 9 Drawing Sheets

(56) References Cited

U.S. PATENT DOCUMENTS

| | | | | |
|---|---|---|---|---|
| 5,953,570 | A * | 9/1999 | Hirai | B82Y 15/00 399/267 |
| 6,512,909 | B2 * | 1/2003 | Ozawa | G03G 13/08 399/265 |
| 7,421,232 | B2 * | 9/2008 | Kreiter | G03G 15/0813 399/164 |
| 7,742,727 | B2 * | 6/2010 | Sakata | G03G 15/0928 399/270 |
| 7,937,008 | B2 * | 5/2011 | Fujishima | G03G 15/0907 399/267 |
| 9,829,829 | B2 * | 11/2017 | Shimizu | G03G 15/0907 |
| 2001/0005458 | A1 * | 6/2001 | Yamanaka | G03G 15/0812 399/43 |
| 2002/0021429 | A1 * | 2/2002 | Sasaki | G03B 27/42 355/53 |
| 2002/0039496 | A1 * | 4/2002 | Aoki | G03G 13/08 399/55 |
| 2007/0206977 | A1 * | 9/2007 | Inoue | G03G 15/0812 399/284 |
| 2009/0214971 | A1 * | 8/2009 | Yoshida | G03G 9/0819 430/97 |
| 2011/0150537 | A1 * | 6/2011 | Watanabe | G03G 15/0839 399/256 |

* cited by examiner

DEVELOPING DEVICE THAT REMOVES TONER ACCUMULATED ON TOP SURFACE OF REGULATING BLADE WITH SIMPLE CONFIGURATION, AND IMAGE FORMING APPARATUS INCLUDING THE SAME

INCORPORATION BY REFERENCE

This application is based upon, and claims the benefit of priority from, corresponding Japanese Patent Application No. 2016-133226 filed in the Japan Patent Office on Jul. 5, 2016, the entire contents of which are incorporated herein by reference.

BACKGROUND

Unless otherwise indicated herein, the description in this section is not prior art to the claims in this application and is not admitted to be prior art by inclusion in this section.

A typical electrophotographic-method image forming apparatus irradiates a circumference surface of an image carrier (a photoreceptor drum) with a light based on image information read from a document image, or image information that is, for example, transmitted from an external device, such as a computer, to form a electrostatic latent image. After a toner is supplied to this electrostatic latent image from a developing device to form a toner image, this toner image is transferred on a paper sheet. The paper sheet after the transfer process is discharged to outside after a fixing process of the toner image is performed.

Recently, in association with progress of achieving color printing and high-speed processing, an image forming apparatus has become to have a complicated device configuration, while a toner stirring member needs to rotate at high speed in a developing device to meet the high-speed processing. Especially, in a development method that uses: a magnetic roller (toner supply roller) that uses a two-component developer including a magnetic carrier and a toner to carry the developer; and a developing roller that carries only the toner, a magnetic brush formed on the magnetic roller carries only the toner on the developing roller and, further, removes the toner, which has not been used for a development, from the developing roller in an opposing portion of the developing roller and the magnetic roller. Thus, in the proximity of the opposing portion of the developing roller and the magnetic roller, a toner float easily occurs, and then the floated toner is accumulated at the periphery of a trimming blade (regulating blade). When the accumulated toner condenses and attaches on the developing roller, a toner dropping occurs, and this may cause an image failure.

Here, for example, in a developing device that uses: a magnetic roller that uses a two-component developer including a magnetic carrier and a toner to carry the developer; and a developing roller that carries only the toner, there is proposed a developing device that includes a toner reception supporting member, a toner reception member, and vibration generating means. The toner reception supporting member is opposed to the developing roller or the magnetic roller. The toner reception member is located along a longitudinal direction of the toner reception supporting member and receives a toner that is dropped from the developing roller. The vibration generating means vibrates the toner reception member.

There is also proposed a developing device that includes a sheet-shaped vibration adjusting member located in both end portions of a toner reception supporting member in a longitudinal direction at a predetermined interval with a toner reception member. In this developing device, the toner reception member contacts the vibration adjusting member when the toner reception member vibrates. This causes the toner reception member to vibrate and wave while bending such that its free end of the toner reception member draws an arc, thus moving the toner accumulated on the free end side of the toner reception member to its fulcrum side.

SUMMARY

A developing device according to one aspect of the disclosure includes a developing roller, a toner supply roller, a regulating blade, a casing, and a cleaning member. The developing roller is located opposed to an image carrier on which an electrostatic latent image is formed. The developing roller supplies a toner to the image carrier in a region opposed to the image carrier. The toner supply roller is located opposed to the developing roller. The toner supply roller forms a magnetic brush made of a two-component developer including a magnetic carrier and a toner on an outer peripheral surface of the toner supply roller to supply a toner to the developing roller in a region opposed to the developing roller. The regulating blade is located opposed to the toner supply roller at a predetermined interval. The casing houses the developing roller, the toner supply roller, and the regulating blade. The cleaning member reciprocates along a longitudinal direction of the regulating blade so as to remove a toner accumulated on a top surface of the regulating blade.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
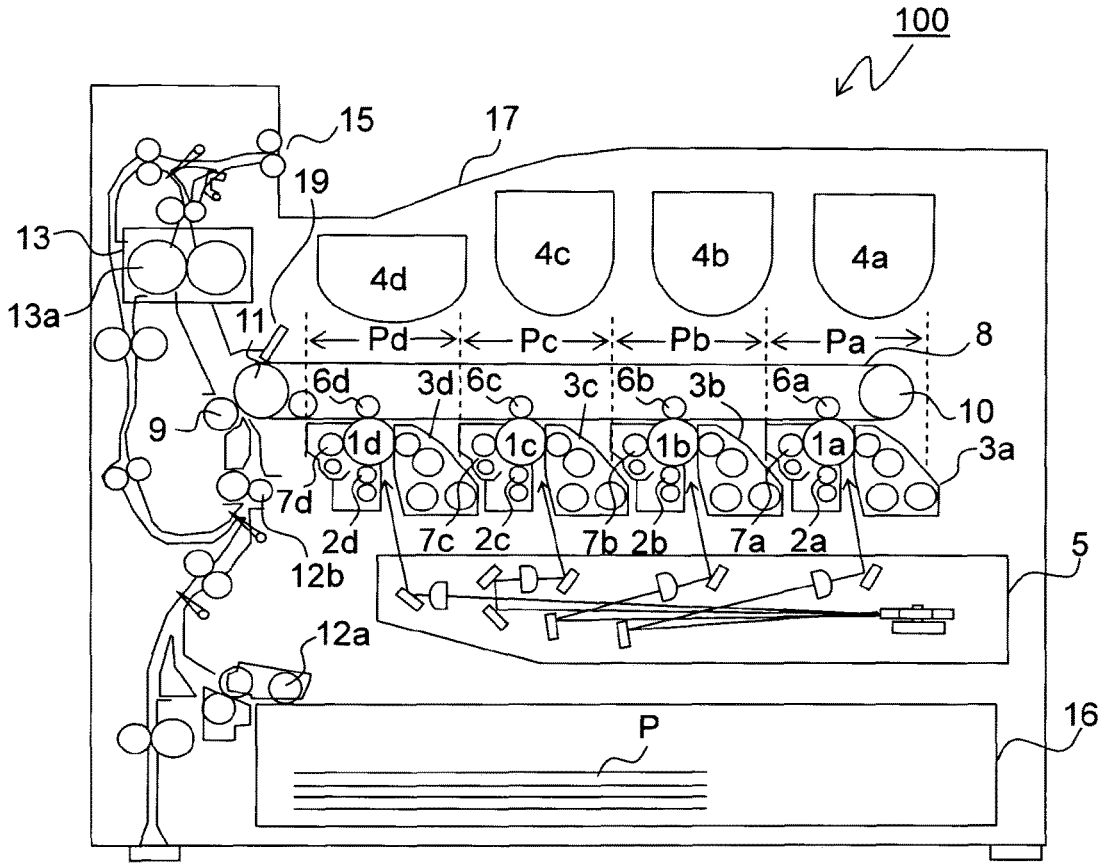
FIG. 1 illustrates a schematic configuration of a color printer including a developing device of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the drawings. FIG. 1 illustrates a schematic cross-sectional view illustrating an image forming apparatus (which is also referred to as color printer) 100 including developing devices 3*a* to 3*d* of the disclosure and illustrates a tandem type color printer here. The color printer 100 includes four image forming units Pa, Pb, Pc, and Pd in this order from an upstream side in a conveyance direction (a right side in FIG. 1) in its main body. These image forming units Pa to Pd are located corresponding to images of four different colors (cyan, magenta, yellow, and black), and sequentially form the images of cyan, magenta, yellow, and black through respective processes of charging, exposure, development, and transfer.

These image forming units Pa to Pd include photoreceptor drums 1*a*, 1*b*, 1*c*, and 1*d*, which carry visible images (toner images) of respective colors. Additionally, an intermediate transfer belt 8, which rotates in a clockwise direction in FIG. 1, is located adjacent to the respective image forming units Pa to Pd.

When image data is input from a host apparatus such as a personal computer, first, chargers 2*a* to 2*d* evenly charge the surfaces of the photoreceptor drums 1*a* to 1*d*, and then an exposure apparatus 5 irradiates the photoreceptor drums 1*a* to 1*d* with light in accordance with the image data to form electrostatic latent images corresponding to the image data on the photoreceptor drums 1*a* to 1*d*. Toner containers 4*a* to 4*d* fill the developing devices 3*a* to 3*d* with predetermined amounts of two-component developers (hereinafter also simply referred to as a developer) including toners of respective colors of cyan, magenta, yellow, and black. The toners in the developers are supplied and electrostatically attached onto the photoreceptor drums 1*a* to 1*d* by the developing devices 3*a* to 3*d*. This forms the toner images corresponding to the electrostatic latent images formed by the exposure by the exposure apparatus 5.

Then, primary transfer rollers 6*a* to 6*d* apply electric fields at predetermined transfer voltages between the primary transfer rollers 6*a* to 6*d* and the photoreceptor drums 1*a* to 1*d*, and the toner images of cyan, magenta, yellow, and black on the photoreceptor drums 1*a* to 1*d* are primarily transferred on the intermediate transfer belt 8. Cleaning units 7*a* to 7*d* remove a remnant toner or similar matter on a surface of the photoreceptor drums 1*a* to 1*d* after the primary transfer.

Paper sheets P, on which toner images are to be transferred, are housed in a paper sheet cassette 16 located in a lower portion in the image forming apparatus 100. The paper sheet P is conveyed to a nip portion (secondary transfer nip portion), which is formed between a secondary transfer roller 9 located adjacent to the intermediate transfer belt 8 and the intermediate transfer belt 8, via a feed roller 12*a* and a registration roller pair 12*b* at a predetermined timing. The transferred paper P on which the toner images have been secondarily transferred is conveyed to a fixing unit 13.

The transferred paper P conveyed to the fixing unit 13 is heated and pressured by a fixing roller pair 13*a*. Then the toner image is fixed on a surface of the paper sheet P, thus forming a predetermined full-color image. The transferred paper P, on which the full-color image is formed, is discharged to a discharge tray 17 by a discharge roller pair 15.

Figure 2:
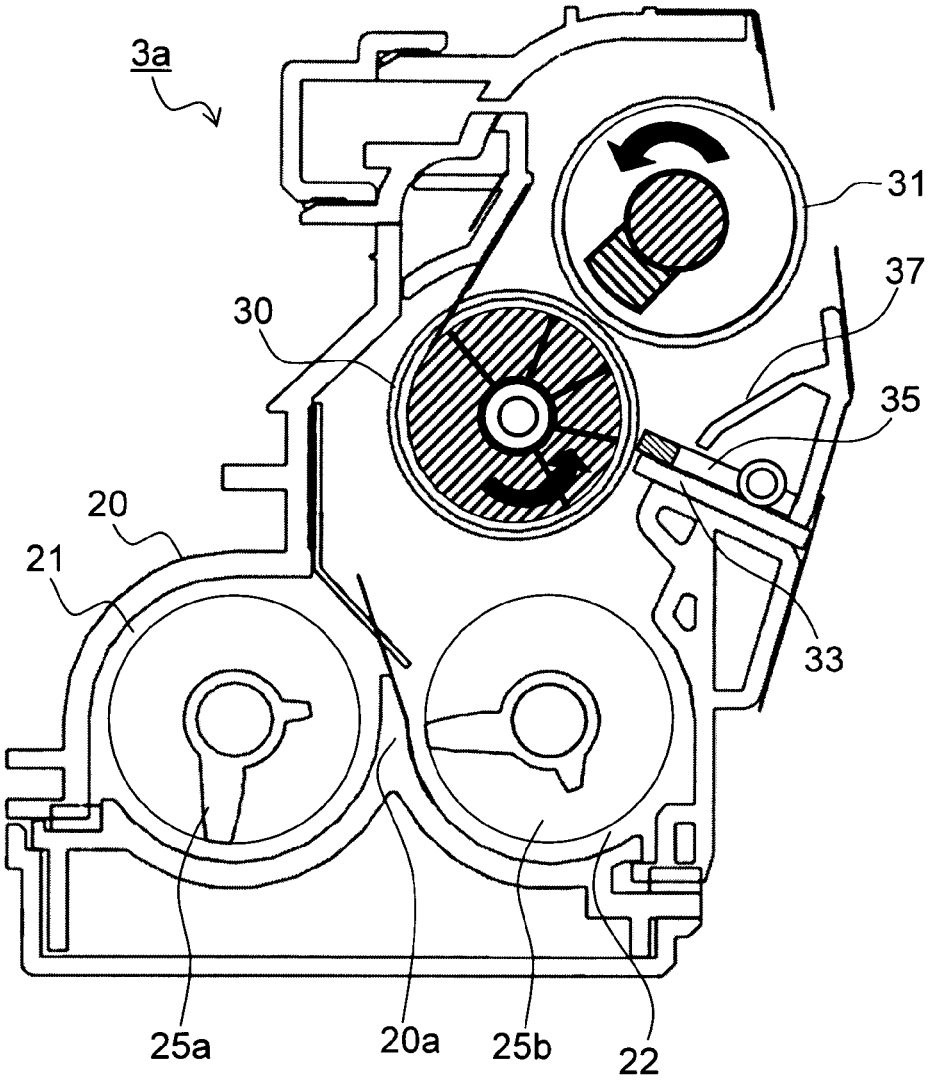
FIG. 2 illustrates a cross-sectional side view illustrating the developing device according to a first embodiment of the disclosure.
Figure 3:
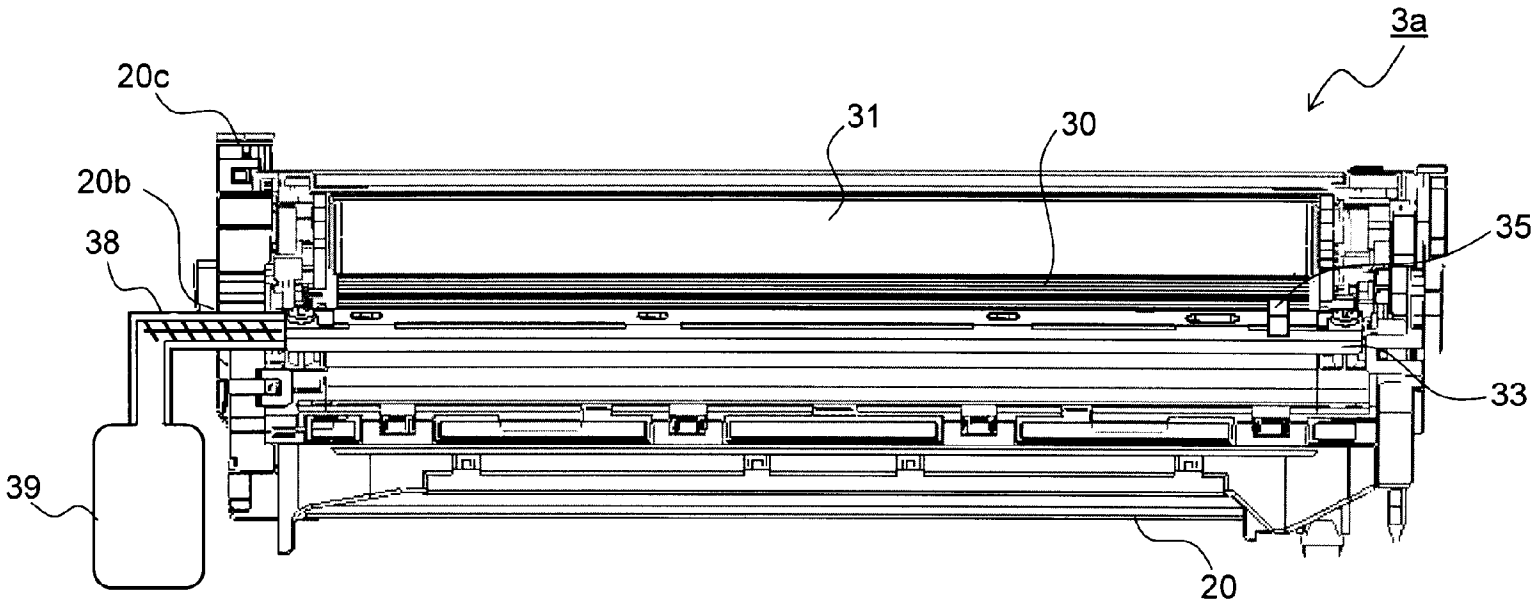
FIG. 3 illustrates a front view when the developing device of the first embodiment is viewed from a right direction in FIG. 2.

FIG. 2 illustrates a cross-sectional side view illustrating the developing device 3*a* according to a first embodiment of the disclosure, and FIG. 3 illustrates a front view when the developing device 3*a* of the first embodiment is viewed from a right direction in FIG. 2. FIG. 2 illustrates a state viewed from a back side in FIG. 1, and locations of respective members, which are in the developing device 3*a*, are reversed with respect to a right and a left in FIG. 1. While the following describes the developing device 3*a* located in the image forming unit Pa of FIG. 1 as an example, configurations of the developing device 3*b* to 3*d* located in the image forming units Pb to Pd are basically identical, and thus their description will be omitted.

As illustrated in FIG. 2, the developing device 3*a* includes a developing container (which is also referred to as casing) 20 that houses the two-component developer (hereinafter also simply referred to as a developer). The developing container 20 is partitioned into a stir conveyance chamber (which is also referred to as first conveyance chamber) 21 and a supply conveyance chamber (which is also referred to as second conveyance chamber) 22 by a partition wall 20*a*. In the stir conveyance chamber 21 and the supply conveyance chamber 22, a stir conveyance screw (which is also referred to as first stirring member) 25*a* and a supply conveyance screw (which is also referred to as second stirring member) 25*b* are each rotatably arranged. The stir conveyance screw 25*a* and the supply conveyance screw 25*b* mix the toner (a positively charged toner) supplied from the toner container 4*a* (see FIG. 1) with a carrier, and stir and charge the toner.

Then, the developer is conveyed in an axial direction (a direction orthogonal to a paper surface of FIG. 2) while being stirred by the stir conveyance screw 25*a* and the supply conveyance screw 25*b*. The developer is circulated between the stir conveyance chamber 21 and the supply conveyance chamber 22 via developer passing portions 20*e* and 20*f* (see FIG. 10) that are formed on both end portions of the partition wall 20*a*. That is, the stir conveyance chamber 21, the supply conveyance chamber 22, and the developer passing portions 20*e* and 20*f* form a circulation route of the developer in the developing container 20.

The developing container 20 obliquely extends toward an upper right in FIG. 2. A toner supply roller 30 (developer carrier) is located above the supply conveyance screw 25*b* in the developing container 20. A developing roller 31 is obliquely located above an upper right of the toner supply roller 30 and opposed to the toner supply roller 30. Then, the developing roller 31 is opposed to the photoreceptor drum 1*a* (see FIG. 1) on an opening side (a right side in FIG. 2) of the developing container 20, and the toner supply roller 30 and the developing roller 31 rotate about respective rotation axes in an anticlockwise direction in FIG. 2.

The stir conveyance chamber 21 includes a toner density sensor (not illustrated) opposed to the stir conveyance screw 25*a*. The toner density sensor detects a proportion (T/C) of the toner to the carrier in the developer. The stir conveyance chamber 21 is replenished with the toner from the toner container 4*a* via a toner replenishment port 20*c* on the basis of a detection result of the toner density sensor. As the toner density sensor, for example, a magnetic permeability sensor that detects magnetic permeability of the two-component developer, which is constituted of the toner and a magnetic carrier, in the developing container 20 is employed.

The toner supply roller 30 is constituted of a non-magnetic rotation sleeve and a fixed magnet body. The rotation sleeve rotates in the anticlockwise direction in FIG. 2. The fixed magnet body has a plurality of magnetic poles internally included in the rotation sleeve.

The developing roller 31 is constituted of a cylindrically-shaped development sleeve and a developing-roller-side-magnetic pole. The development sleeve rotates in the anticlockwise direction in FIG. 2. The developing-roller-side-magnetic pole is secured into the development sleeve. The toner supply roller 30 and the developing roller 31 are opposed to one another at their facing positions (opposing positions) at a predetermined clearance. The developing-roller-side-magnetic pole has a polarity different from a magnetic pole (main pole) opposed to the fixed magnet body.

In the developing container 20, a trimming blade 33 (regulating blade) is mounted along a longitudinal direction (the direction orthogonal to the paper surface of FIG. 2) of the toner supply roller 30. The trimming blade 33 is located on an upstream side with respect to the opposing position of the developing roller 31 and the toner supply roller 30 in a rotation direction (the anticlockwise direction in FIG. 2) of the toner supply roller 30. Then, a slight gap is formed between a distal end portion of the trimming blade 33 and a surface of the toner supply roller 30.

A DC voltage (hereinafter referred to as Vslv (DC)) and an AC voltage (hereinafter referred to as Vslv (AC)) are applied to the developing roller 31. A DC voltage (hereinafter referred to as Vmag (DC)) and an AC voltage (hereinafter referred to as Vmag (AC)) are applied to the toner supply roller 30. These DC voltages and AC voltages are applied to the developing roller 31 and the toner supply roller 30 via a bias control circuit from a developing bias power source (each of components is not illustrated).

As described above, the developer is circulated in the stir conveyance chamber 21 and the supply conveyance chamber 22, which are in the developing container 20, while being stirred by the stir conveyance screw 25*a* and the supply conveyance screw 25*b*. Then, the toners in the developer are charged, and the developer is conveyed to the toner supply roller 30 by the supply conveyance screw 25*b*. Then, a magnetic brush (not illustrated) is formed on the toner supply roller 30. The trimming blade 33 regulates a layer thickness of the magnetic brush on the toner supply roller 30. After that, the rotation of the toner supply roller 30 conveys the magnetic brush to an opposing portion of the toner supply roller 30 and the developing roller 31. Then, an electric potential difference ΔV between Vmag (DC) applied to the toner supply roller 30 and Vslv (DC) applied to the developing roller 31, and a magnetic field form a thin toner layer on the developing roller 31.

While a toner layer thickness on the developing roller 31 changes due to, for example, a resistance of the developer, and a rotation speed difference between the toner supply roller 30 and the developing roller 31, the toner layer thickness is controlled by ΔV. When ΔV is increased, the toner layer on the developing roller 31 becomes thick. When ΔV is reduced, the toner layer becomes thin. An appropriate range of ΔV during the development is, typically, around 100 V to 350 V.

The rotation of the developing roller 31 conveys the thin toner layer formed on the developing roller 31 by a contact with the magnetic brush on the toner supply roller 30 to the opposing portion (an opposing region) of the photoreceptor drum 1*a* and the developing roller 31. Vslv (DC) and Vslv (AC) are applied to the developing roller 31, and thus an electric potential difference between the photoreceptor drum 1*a* flies the toner to develop an electrostatic latent image on the photoreceptor drum 1*a*.

The toner left on the developing roller 31, which has not been used in the development, is conveyed to the opposing portion of the developing roller 31 and the toner supply roller 30 again by the rotation of the developing roller 31, and then is recovered by the magnetic brush on the toner supply roller 30. Then, the magnetic brush is dropped into the supply conveyance chamber 22 after being removed from the toner supply roller 30 at an identical pole portion of the fixed magnet body.

After that, a toner in a predetermined amount is replenished on the basis of a detection result of the toner density sensor (not illustrated) from a toner replenishment port (not illustrated), so as to generate the two-component developer, which is uniformly charged at an appropriate toner density again, while circulating in the supply conveyance chamber 22 and the stir conveyance chamber 21. This developer is supplied onto the toner supply roller 30 by the supply conveyance screw 25*b* again to form the magnetic brush, so as to be conveyed to the trimming blade 33.

A cleaning member 35 that removes the toner accumulated on a top surface of the trimming blade 33 is located at a proximity of the developing roller 31 on a right side wall of the developing container 20 in FIG. 2. As illustrated in FIG. 2, the cleaning member 35 is located inside a wall portion 37 inclining downward toward the toner supply roller 30 direction from the developing roller 31 in the developing container 20. The cleaning member 35 enables the reciprocation along a longitudinal direction (the direction orthogonal to the paper surface of FIG. 2) of the trimming blade 33. The cleaning member 35 is located at a reference position on one end side of (a far-side of the paper surface of FIG. 2) of the longitudinal direction of the trimming blade 33 in a standby state.

As illustrated in FIG. 3, a connecting portion 20*b*, which is connected to a toner conveyance path 38, is formed in one end portion of a longitudinal direction of the developing container 20. The connecting portion 20*b* is formed in an end portion of a downstream side (a left side in FIG. 3) with respect to a movement direction from the reference position of the cleaning member 35, and the toner removed from the trimming blade 33 by the cleaning member 35 is conveyed to a toner recovery container 39 via the toner conveyance path 38.

Figure 4:
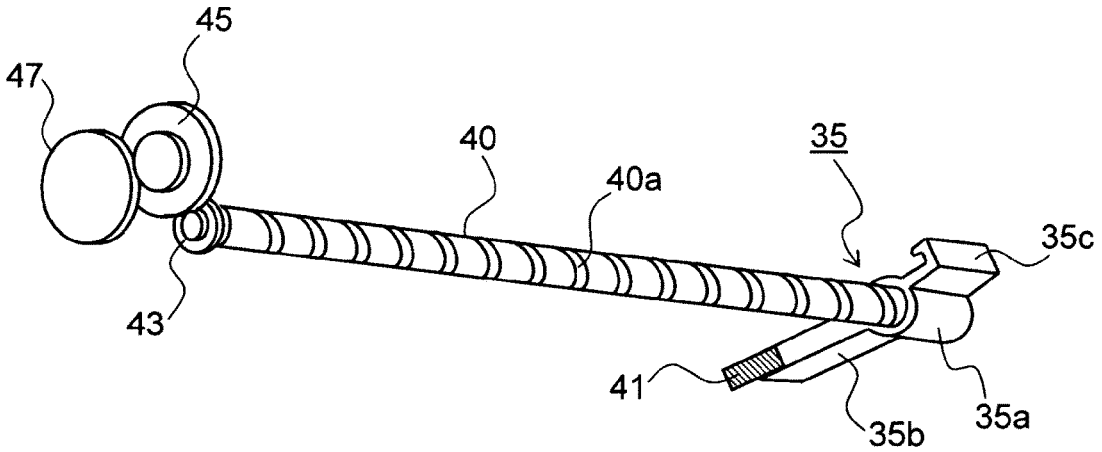
FIG. 4 obliquely illustrates a driving mechanism of a cleaning member used in the developing device of the first embodiment and illustrates a state where the cleaning member is located on one end side (a reference position) of a trimming blade.
Figure 5:
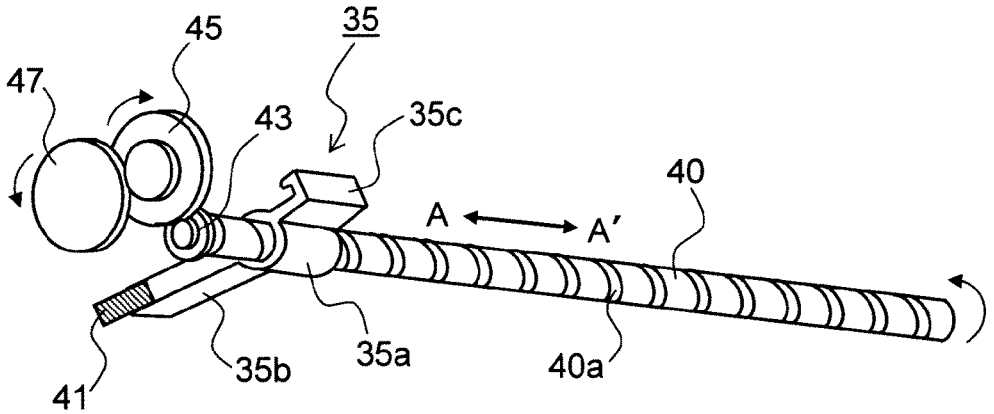
FIG. 5 obliquely illustrates the driving mechanism of the cleaning member used in the developing device of the embodiment and illustrates a state where the cleaning member is moved to the other end side.
Figure 6:
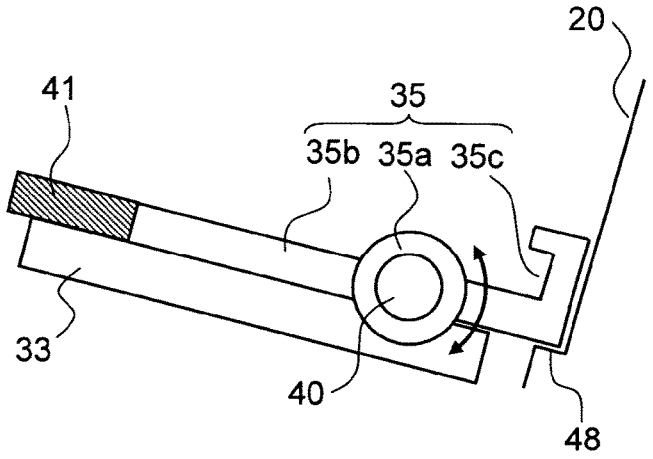
FIG. 6 illustrates a side view illustrating the trimming blade and the cleaning member viewed from a downstream side in a movement direction of the cleaning member.
Figure 7:
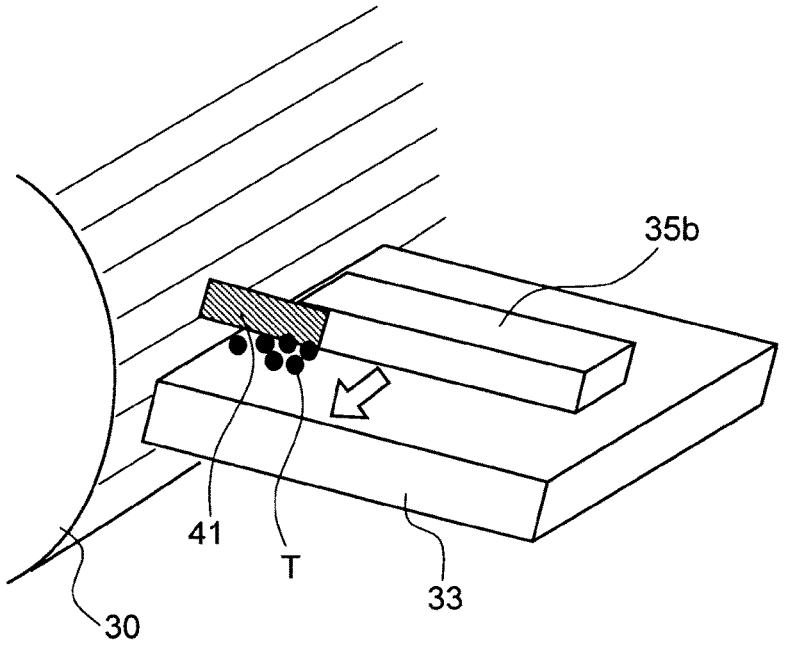
FIG. 7 schematically illustrates a perspective view illustrating a state where the cleaning member recovers a toner accumulated on a top surface of the trimming blade.

FIGS. 4 and 5 obliquely illustrate a driving mechanism of the cleaning member 35 employed in the developing device 3*a* of the first embodiment. FIG. 4 illustrates a state where the cleaning member 35 is located on one end side (the reference position) of the trimming blade 33. FIG. 5 illustrates a state where the cleaning member 35 has been moved to the other end side. FIG. 6 illustrates a side view illustrating the trimming blade 33 and the cleaning member 35 viewed from a downstream side (a left side in FIG. 5) of the movement direction of the cleaning member 35. FIG. 7 schematically illustrates a perspective view illustrating a state where the cleaning member 35 recovers the toner accumulated on the top surface of the trimming blade 33.

As illustrated in FIG. 4, the cleaning member 35 includes a cylindrically-shaped supporting portion 35*a*, a cleaning portion 35*b*, and a regulating portion 35*c*. The supporting portion 35*a* is externally inserted into a shaft 40. The cleaning portion 35*b* extends along the top surface of the trimming blade 33 from the supporting portion 35*a*. The regulating portion 35*c* projects in a direction opposite to the cleaning portion 35*b* from the supporting portion 35*a*.

While a material of the cleaning member 35 is not specifically limited, it is necessary that a material having a small friction coefficient with respect to the metallic trimming blade 33 be employed in order to smoothly slide the cleaning member 35 along the top surface of the trimming blade 33. Specifically, a common resin material, such as polyethylene resin and polypropylene resin, can be employed.

When the cleaning portion 35*b* is extended up to a distal end of the trimming blade 33 so as to remove the toner accumulated on an edge portion of the distal end of the trimming blade 33, the cleaning portion 35*b* having a high rigidity may strip the magnetic brush formed on an outer peripheral surface of the toner supply roller 30 or damage the toner supply roller 30. Thus, in a distal end of the cleaning portion 35*b*, a flexibility sheet member 41 is provided. This configuration ensures removing the toner accumulated on the edge portion of the distal end of the trimming blade 33 without generating the striped magnetic brush or the damaged toner supply roller 30.

The sheet member 41 is located such that the sheet member 41 contacts the magnetic brush formed on the outer peripheral surface of the toner supply roller 30. Urethane or PET (polyethylene terephthalate) is preferred as a material of the sheet member 41 in order that the sheet member 41 lightly contacts to the extent that the magnetic brush of the toner supply roller 30 is not stripped. While the sheet member 41 may be located such that a distal end of the sheet member 41 contacts the toner supply roller 30, in this case, it is necessary that the material and a thickness of the sheet member 41 be adjusted such that the toner supply roller 30 is not damaged. It is preferred that the thickness of the sheet member 41 be 50 μm to 300 μm in the case of a urethane sheet and be around 50 μm to 200 μm in the case of a PET sheet.

The shaft 40, which is internally inserted into the supporting portion 35*a* of the cleaning member 35, has an outer peripheral surface on which a spiral groove portion 40*a* is formed. An inner circumference surface of the supporting portion 35*a* includes a spiral protrusion (not illustrated) that engages the groove portion 40*a*. A driving input gear 43 is secured to one end of the shaft 40, and the driving input gear 43 receives a driving power of a motor 51 (see FIG. 8) via gears 45 and 47.

Next, the following describes a clean operation where the cleaning member 35 removes the toner accumulated on the top surface of the trimming blade 33. As described above, the toner, which has not been used for the development and is on the developing roller 31, is removed at the opposing portion of the toner supply roller 30 and the developing roller 31 from the developing roller 31, and then is recovered by the magnetic brush on the toner supply roller 30. At this time, a part of the toner removed from the developing roller 31 is dropped without being recovered by the magnetic brush. The dropped toner slides off along an incline of the wall portion 37 (see FIG. 2) to be accumulated near a distal end portion of the top surface of the trimming blade 33.

Thus, as illustrated in FIG. 5, when an image is not formed and when the motor 51 is driven to rotate the gear 47 in an anticlockwise direction, the gear 45 connected to the gear 47 rotates in a clockwise direction, causing the driving input gear 43 connected to the gear 45 to rotate in the anticlockwise direction. This rotates also the shaft 40 to which the driving input gear 43 is secured in an anticlockwise direction in FIG. 5, causing a phase of the spiral groove portion 40*a*, which is formed on the shaft 40, to move in an arrow-A direction. Consequently, in association with the moved phase of the groove portion 40*a*, the cleaning member 35, which engages the groove portion 40*a* in the supporting portion 35*a*, moves from the reference position (a right end in FIG. 3) up to the other end side of the trimming blade 33 (a left end in FIG. 3) in the arrow-A direction. At this time, as illustrated in FIG. 6, the cleaning member 35 is held in a posture where the anticlockwise rotation of the shaft 40 presses the cleaning portion 35*b* to the top surface of the trimming blade 33.

As illustrated in FIG. 7, the movement of the cleaning member 35 causes the cleaning portion 35*b* and the sheet member 41 to scrape a toner T accumulated on the top surface of the trimming blade 33. The scraped toner moves in the longitudinal direction of the trimming blade 33 to convey outside the developing container 20 from an end portion of the trimming blade 33 via the toner conveyance path 38, so as to be recovered by the toner recovery container 39.

After that, when the inverted driving of the motor 51 rotates the gear 47 in the clockwise direction, the gear 45 connected to the gear 47 rotates in the anticlockwise direction, causing the driving input gear 43 connected to the gear 45 rotate in the clockwise direction. This rotates also the shaft 40, to which the driving input gear 43 is secured, in the clockwise direction in FIG. 5, causing the phase of the spiral groove portion 40*a*, which is formed on the shaft 40, to move in an arrow-A' direction.

As illustrated in FIG. 6, on an inner surface of the developing container 20, a stepped portion 48 is formed along the longitudinal direction of the trimming blade 33. The clockwise rotation of the shaft 40 causes the regulating portion 35*c* of the cleaning member 35 to abut on the stepped portion 48. This holds the cleaning member 35 in a posture where the cleaning portion 35*b* contacts the trimming blade 33 as illustrated in FIG. 6 without corotation along with the shaft 40 in the clockwise direction. As a result, in association with the moved phase of the groove portion 40*a*, the cleaning member 35 moves up to the reference position (the position in FIG. 4) from the position in FIG. 5 in the arrow-A' direction to be returned into the standby state.

In the configuration of the embodiment, the cleaning member 35 scrapes the toner accumulated on the top surface of the trimming blade 33 to ensure the reduction of the toner accumulated on the top surface of the distal end of the trimming blade 33. Consequently, this ensures the effectively reduced generation of toner drop due to an attachment of the toner accumulated on the top surface of the distal end of the trimming blade 33 on the magnetic brush of the toner supply roller 30 during the image formation, and an additional attachment on the developing roller 31.

The cleaning member 35 waits at the reference position (the position in FIG. 4) that is not opposed to the outer peripheral surface of the toner supply roller 30 except when removing the toner accumulated on the top surface of the trimming blade 33. This eliminates the possibility that the image is adversely affected because the sheet member 41 of the cleaning member 35 contacts the magnetic brush of the toner supply roller 30 during the image formation.

As a timing of moving the cleaning member 35, the movement may be performed at a predetermined timing, such as each time a printing operation is terminated, a time point when the number of printed sheets reaches the predetermined number of printed sheets, and a time point when a temperature in the developing device 3*a* is equal to or more than a predetermined temperature. The cleaning member 35 is moved every time the number of printed sheets reaches the predetermined number, causing the cleaning member 35 to automatically perform cleaning in accordance with the number of printed sheet. Thus, it is not necessary for the user to perform manual setting for cleaning by the cleaning member 35 by himself/herself. This ensures the reduction of setting error, forgetting the setting, or performing unnecessary cleaning.

The toner removed from the top surface of the trimming blade 33 by the cleaning member 35 is recovered by the toner recovery container 39 via the toner conveyance path 38 without being returned into the supply conveyance chamber 22. Thus, this ensures the effectively reduced generation of scattered toner particles or a fog image due to reuse of a toner having a low charge amount or a reversely charged toner, which is accumulated on the top surface of the trimming blade 33, for a development.

Figure 8:
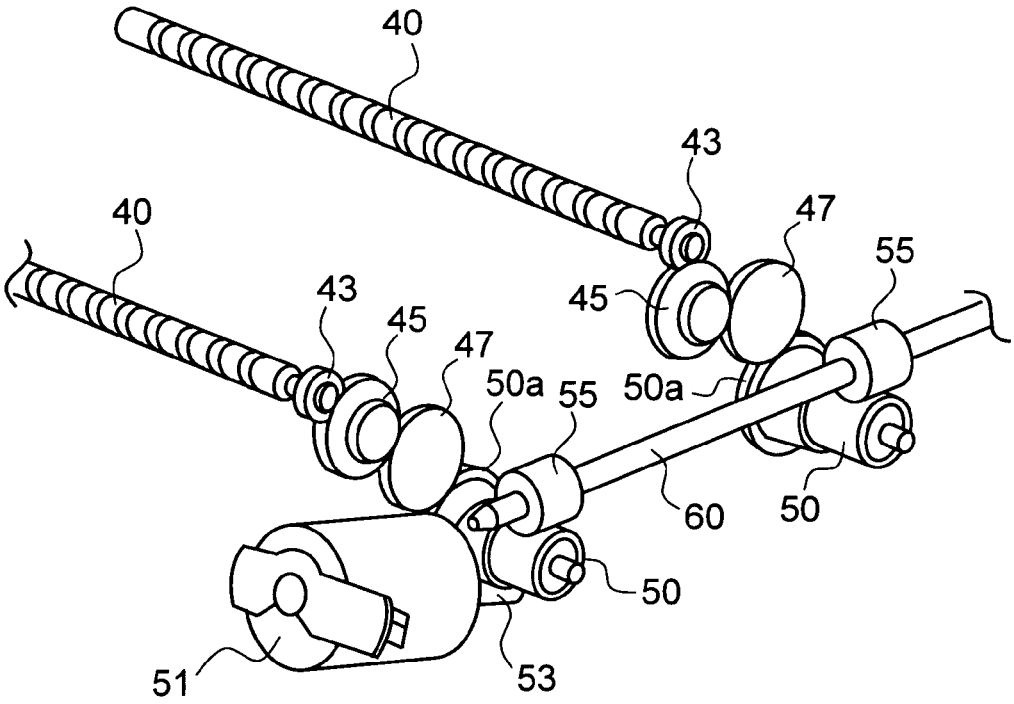
FIG. 8 obliquely illustrates a transmission mechanism of a driving power from a motor to a shaft.

FIG. 8 obliquely illustrates a transmission mechanism of a driving power from the motor 51 to the shaft 40. FIG. 8 illustrates the transmission mechanism of the driving power to the shaft 40 (a left side in FIG. 8) of the developing device 3*a* and a shaft 40 (a right side in FIG. 8) of the developing device 3*b*. Driving input gears 43 of respective shafts 40 are connected to spur portions 50*a* of worm gears 50 via the gears 45 and 47.

A pinion gear 53 secured to an output shaft of the motor 51 is connected to one of the worm gears 50. Thus, a rotary drive power of the motor 51 has a transmission direction perpendicularly converted via the worm gear 50 to be transmitted to the shaft 40 (a left side in FIG. 8) of the developing device 3*a* via the gears 47 and 45 and the driving input gear 43.

The respective worm gears 50 connect to drive transmission gears 55 where the respective worm gears 50 and rotation axis are orthogonal. The respective drive transmission gears 55 are secured to a common rotation shaft 60. The developing devices 3*c* and 3*d* also include transmission mechanisms (not illustrated here) of the driving power to the shafts 40 having an identical configuration, and the rotary drive power of the motor 51 is transmitted to the worm gears 50 via the drive transmission gears 55 secured to the rotation shaft 60.

The configuration illustrated in FIG. 8 ensures the simultaneous operation of cleaning members 35 in the developing devices 3*a* to 3*d* using the one motor 51. This eliminates the need for separately disposing a motor for moving the cleaning members 35 in the respective developing devices 3*a* to 3*d*, thus ensuring the simplified control path.

Figure 9:
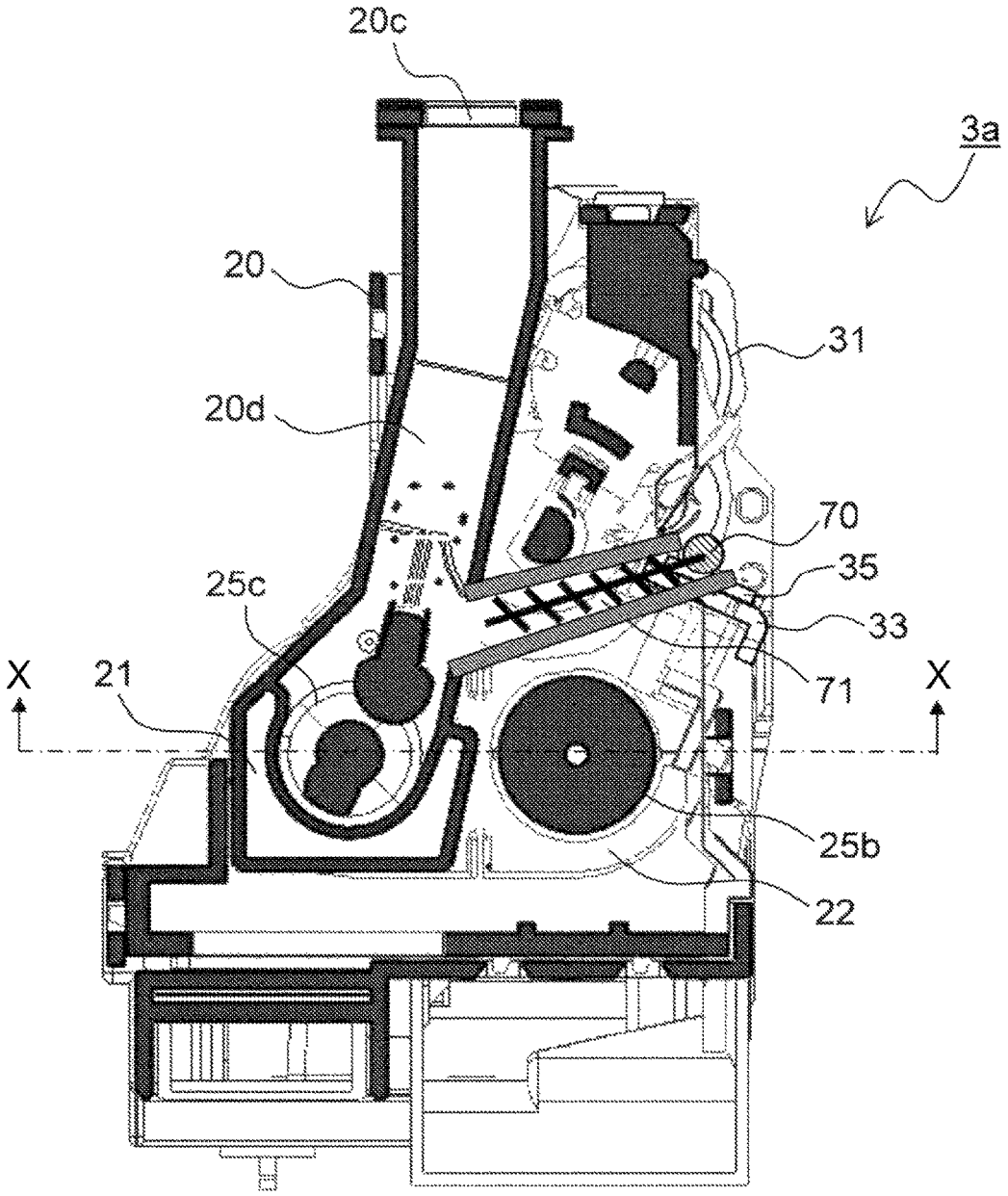
FIG. 9 illustrates a cross-sectional side view near a toner replenishment port of the developing device according to a second embodiment of the disclosure.
Figure 10:
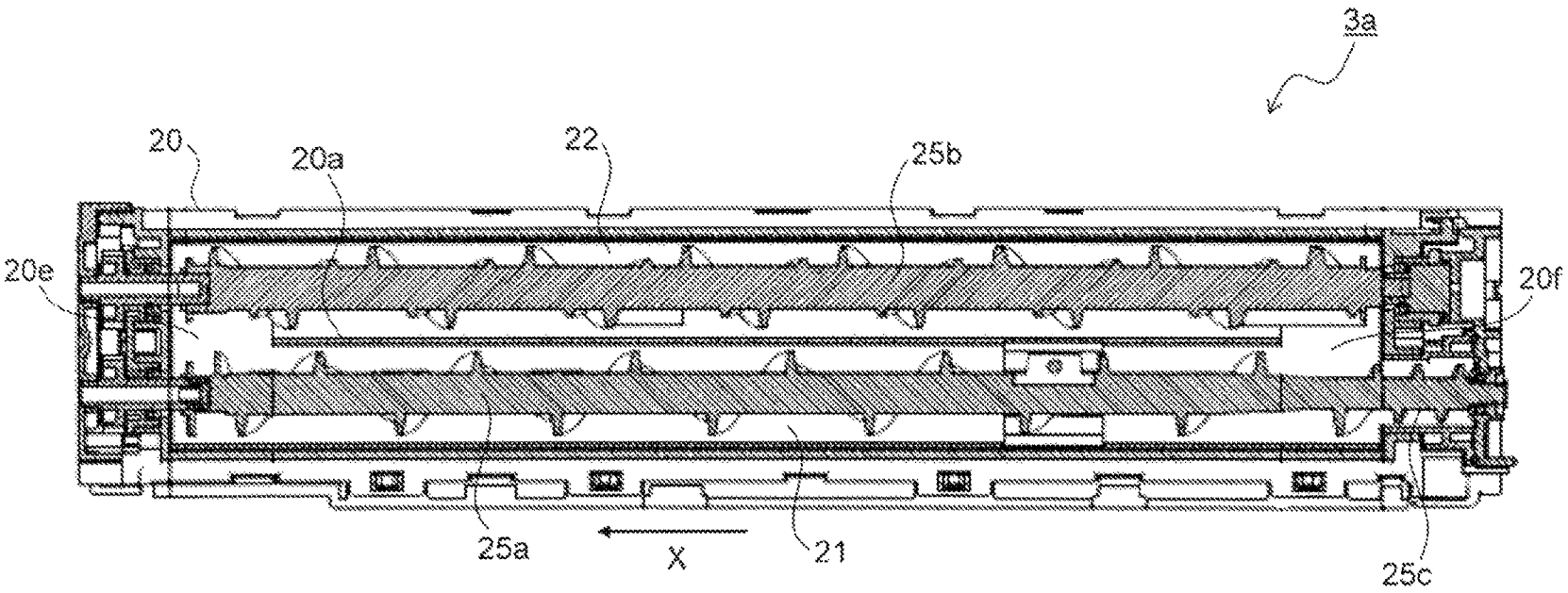
FIG. 10 illustrates a cross-sectional plan view illustrating a stirring portion in the developing device of the second embodiment.

FIG. 9 illustrates a cross-sectional side view near the toner replenishment port 20*c* of the developing device 3*a* according to a second embodiment of the disclosure. FIG. 10 illustrates a cross-sectional plan view (a cross-sectional view taken along the line X-X in FIG. 9) illustrating a stirring portion in the developing device 3*a* of the second embodiment. The developing device 3*a* of the embodiment includes a conveyance spiral 70 and a toner recovery path 71. The conveyance spiral 70 conveys the toner removed from the top surface of the trimming blade 33 by the cleaning member 35. The toner recovery path 71 returns the toner removed by the conveyance spiral 70 to the stir conveyance chamber 21. Configurations of the other portions of the developing device 3*a*, such as the cleaning member 35 and the driving mechanism of the cleaning member 35, are similar to the first embodiment.

As illustrated in FIG. 9, the toner replenished via the toner replenishment port 20*c* from the toner container 4*a* (see FIG. 1) passes through an inside of a toner replenishment path 20*d* to reach a replenished-toner conveyance screw 25*c*. As illustrated in FIG. 10, the replenished-toner conveyance screw 25*c* is formed coaxially with a rotation axis of the stir conveyance screw 25*a* on an upstream side (a right side in FIG. 10) of a conveyance direction of the stir conveyance screw 25*a*. The replenished toner is handed over to the stir conveyance screw 25*a* by the replenished-toner conveyance screw 25*c* to be conveyed to an inside of the stir conveyance chamber 21 in an arrow-X direction while being mixed with the carrier in the stir conveyance chamber 21, so as to be charged at a predetermined charge amount.

The conveyance spiral 70 and the toner recovery path 71 are located on the downstream side (a paper-surface-front side in FIG. 9) of the movement direction of the cleaning member 35. A lower end portion of the toner recovery path 71 communicates with the toner replenishment path 20*d*. A rotation of the conveyance spiral 70 moves the toner removed from the top surface of the trimming blade 33 by the cleaning member 35 inside the toner recovery path 71 to be conveyed to the inside of the toner replenishment path 20*d*. Then, this toner reaches the replenished-toner conveyance (stirring) screw 25*c* after being joined to the replenished toner, which passes through the inside of the toner replenishment path 20*d*.

According to the configuration of the embodiment, the toner removed from the top surface of the trimming blade 33 passes through the toner recovery path 71, and then is recovered at an end portion (a right edge in FIG. 10) of an upstream side with respect to a developer conveyance direction in the stir conveyance chamber 21. Thus, the toner having a low charge amount or the reversely charged toner, which is accumulated on the top surface of the trimming blade 33, is sufficiently mixed with the carrier while being stirred and conveyed from one end side (the right edge in FIG. 10) of a longitudinal direction of the stir conveyance chamber 21 to the other end side (a left side in FIG. 10). Then, the toner passes through the developer passing portion 20*e* to be conveyed to the supply conveyance chamber 22 after a uniform charge. After that, in the supply conveyance chamber 22, the toner is supplied to the toner supply roller 30 to be used for a development again.

Thus, this ensures the effectively reduced generation of scattered toner particles or a fog image due to use of the toner having a low charge amount or the reversely charged toner for a development after the supply to the toner supply roller 30. Additionally, the reusability of the toner removed from the top surface of the trimming blade 33 for a development ensures the reduced waste toner and eliminates the need for disposing the toner recovery container 39 that recovers the waste toner.

The disclosure is not limited to the above-described respective embodiments and can be variously modified without departing from the spirit of the disclosure. For example, the shape and the configuration of the cleaning member 35, which are described in the above-described respective embodiments, are examples, are not particularly limited to the above-described embodiments, and these are appropriately determined corresponding to, for example, a device configuration.

For example, while the above-described respective embodiments include a configuration where the rotation of the shaft 40 having the outer peripheral surface on which the spiral groove portion 40*a* is formed reciprocates the cleaning member 35, a rack-and-pinion mechanism that is constituted of a rack gear and a pinion gear that meshes with the rack gear instead of the shaft 40 may be employed so as to reciprocate the cleaning member 35.

Figure 11:
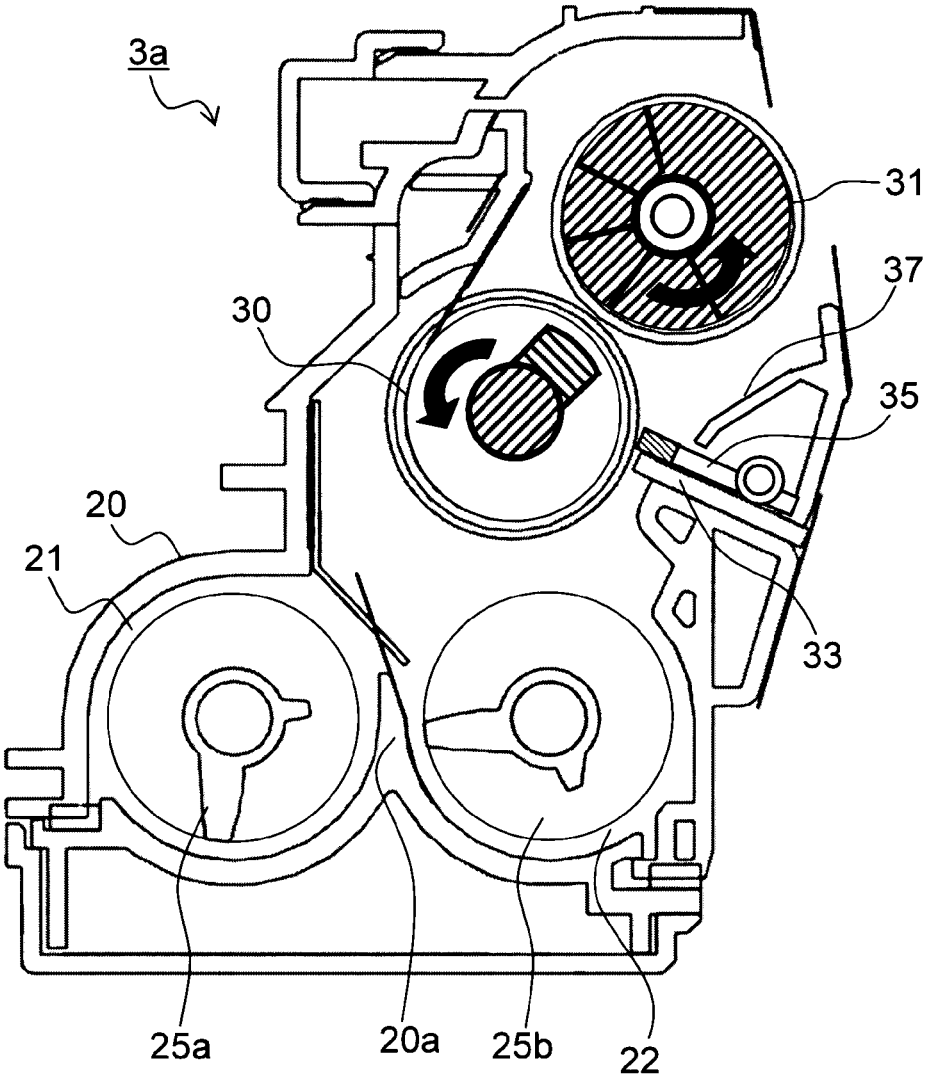
FIG. 11 illustrates a cross-sectional side view illustrating the developing device of the disclosure where a toner supply roller and a developing roller are reversely positioned.

While in the above-described respective embodiments the disclosure is applied to the developing devices 3*a* to 3*d*, which use the two-component developers, form the magnetic brush on the toner supply roller 30, move only toners to the developing roller 31 from the toner supply roller 30, and then supply the toners to the photoreceptor drums 1*a* to 1*d* from the developing roller 31, in addition, as illustrated in FIG. 11, the disclosure is also applicable to a developing device where the developing roller 31 and the toner supply roller 30 are positioned reversely to the above-described embodiments. In this developing device, the magnetic brush made of the two-component developer that is held on a surface of the developing roller 31 (that is a magnetic roller having the configuration similar to the toner supply roller 30 of the above-described embodiments in the configuration) supplies toners to the photoreceptor drums 1*a* to 1*d*. Then, the toner held on the surface of the toner supply roller 30 (that has the configuration similar to the developing roller 31 of the above-described embodiments in the configuration) is supplied to the developing roller 31, and a surplus toner, which is on the surface of the developing roller 31, is recovered using the toner supply roller 30. Even this configuration ensures the effective reduction of the toner dropped from the developing roller 31 is accumulated on the periphery of the trimming blade 33, which is opposed to the toner supply roller 30.

The disclosure is applicable to a developing device that includes a wall portion opposed to a developing roller between an opposing region of an image carrier and the developing roller, and a regulating blade. Use of the disclosure ensures providing that includes: a developing device that removes the toner accumulated on a top surface of a regulating blade regardless of fluidity of a toner with a simple constitution; and an image forming apparatus including the same.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A developing device comprising:

a developing roller located opposed to an image carrier on which an electrostatic latent image is formed, the developing roller supplying a toner to the image carrier in a region opposed to the image carrier;

a toner supply roller located opposed to the developing roller, the toner supply roller forming a magnetic brush made of a two-component developer including a magnetic carrier and a toner on an outer peripheral surface of the toner supply roller to supply a toner to the developing roller in a region opposed to the developing roller;

a regulating blade located opposed to the toner supply roller at a predetermined interval;

a casing that houses the developing roller, the toner supply roller, and the regulating blade; and a cleaning member that reciprocates along a longitudinal direction of the regulating blade so as to remove a toner accumulated on a top surface of the regulating blade.

2. The developing device according to claim 1, wherein the cleaning member includes a cleaning portion that slides along the top surface of the regulating blade, the cleaning portion having an end portion at the toner supply roller side, the end portion including a flexible sheet member, the sheet member contacting a magnetic brush, the magnetic brush being formed on the outer peripheral surface of the toner supply roller.

3. The developing device according to claim 1, wherein:

the cleaning member includes a cylindrically-shaped supporting portion that is externally inserted into a shaft extending in the longitudinal direction of the regulating blade, the supporting portion including a protrusion that engages a spiral groove portion formed on an outer peripheral surface of the shaft, and a regulating portion that regulates a rotation of the cleaning member in association with a rotation of the shaft; and a rotation of the shaft in forward and reverse directions in a state where the rotation of the cleaning member is regulated reciprocates the cleaning member along the shaft.

4. The developing device according to claim 1, wherein:

the cleaning member is located at a reference position, the reference position being located on one end side of the regulating blade without being opposed to the outer peripheral surface of the toner supply roller; and after the cleaning member moves to another end side of the regulating blade from the reference position so as to remove the toner accumulated on the top surface of the regulating blade, the cleaning member returns to the reference position again.

5. The developing device according to claim 4, wherein:

a connecting portion is formed at a position opposed to the other end side of the regulating blade in the developing container, the connecting portion connecting to a toner conveyance path; and the toner removed from the regulating blade by the cleaning member is conveyed to a toner recovery container via the toner conveyance path.

6. The developing device according to claim 4, wherein:

the developing container includes a first conveyance chamber including a first stirring member that stirs and conveys a developer in a rotation axis direction, a second conveyance chamber including a second stirring member that stirs and conveys a developer in a direction opposite to the first stirring member, and supplies a developer to the toner supply roller, and developer passing portions communicates between the first conveyance chamber and the second conveyance chamber on both end portions side of the first conveyance chamber and the second conveyance chamber in a longitudinal direction; and a toner recovery path is formed at a position opposed to the other end side of the regulating blade in the developing container, the toner recovery path returning the toner removed from the regulating blade by the cleaning member to the first conveyance chamber.

7. The developing device according to claim 6, wherein the toner recovery path returns the toner removed from the regulating blade by the cleaning member to an upstream-side end portion of the first conveyance chamber with respect to a developer conveyance direction in the first conveyance chamber.

8. The developing device according to claim 1, wherein the toner supply roller internally includes a plurality of magnetic poles, the toner supply roller being a magnetic roller where the plurality of magnetic poles carry the two-component developer.

9. The developing device according to claim 1, wherein the developing roller internally includes a plurality of magnetic poles, the toner supply roller being a magnetic roller where the plurality of magnetic poles carry the two-component developer.

10. An image forming apparatus comprising the developing device according to claim 1.

11. The image forming apparatus according to claim 10, further comprising:

a plurality of the developing devices; wherein the cleaning members included in the respective developing devices are simultaneously moved using one motor.

* * * * *